US005540440A

United States Patent [19]

Liu

[11] Patent Number: 5,540,440

[45] Date of Patent: Jul. 30, 1996

[54] BASEBALL CHESS GAME

[76] Inventor: Lisong Liu, 1550 Farnell Ct. #7, Decatur, Ga. 30033

[21] Appl. No.: 521,040

[22] Filed: Aug. 29, 1995

[51] Int. Cl.[6] ..... A63F 3/00

[52] U.S. Cl. ..... 273/259; 273/244

[58] Field of Search ..... 273/88, 93 R, 273/242, 243, 244, 259

[56] References Cited

U.S. PATENT DOCUMENTS

| | | | |
|---|---|---|---|
| D. 253,900 | 1/1980 | Arvonen | D21/28 |
| D. 340,746 | 10/1993 | Breen et al. | D21/14 |
| 1,349,615 | 8/1920 | Koellhoffer | 273/259 |
| 2,769,639 | 11/1956 | Seale | 273/244 X |
| 2,886,319 | 5/1959 | Henderson | 273/244 X |
| 2,933,316 | 4/1960 | Mancini | 273/244 X |
| 3,428,317 | 2/1969 | Pulcifer | 273/93 R |
| 3,972,530 | 8/1976 | Dohn | 273/88 |
| 4,179,123 | 12/1979 | Tsukuda | 273/89 |
| 4,452,453 | 6/1984 | Daley et al. | 273/93 R |
| 4,657,254 | 4/1987 | Renner | 273/259 X |
| 5,129,651 | 7/1992 | Tobias | 273/244 X |
| 5,183,266 | 2/1993 | Kohler | 273/88 |

*Primary Examiner*—William E. Stoll
*Attorney, Agent, or Firm*—Bernstein & Associates

[57] ABSTRACT

A baseball board game comprising three game boards, two of which represent offensive and defensive players, the third of which represents the field of play. The field of play board is generally in the shape of a baseball diamond, but is divided into vertical and horizontal polar coordinates. The field of play also has zones upon it to account for scoring, balls, strikes and player positioning. A ball shaped marker is used to designate the position of the ball on the field and player markers designate the position of players on the field. The game may be played with either specially marked dice and one player board or with the use of the two player boards. Each of the player boards can be interchangeably used as the offensive or defensive team. Each player board illustrates a zone for an air or ground ball, a six by six coordinate system for placement of a hit ball, a bad ball zone and a stolen base zone.

12 Claims, 5 Drawing Sheets

BASEBALL CHESS GAME

FIELD OF THE INVENTION

The present invention relates to a board game for playing the game of baseball, and more particularly, to a board game utilizing three dependent interactive game boards having a polar coordinate system to place balls and players on a playing field, and which simulates the strategy decisions which are confronted in the actual game of baseball.

BACKGROUND OF THE ART

Over the last century baseball enthusiasts have created numerous board, action, and electronic games to simulate the play of a baseball game on a personal level. These games have often been based on actions and reactions without taking into account the strategic decisions made by the actual players during the course of play. Baseball board games based on physical action often leave the course of a game substantially to chance, rather than to the player's decisions for directing the course of events. These type of games often use the role of the dice to determine outcome. The board games often use projectiles to simulate a baseball and a means for propelling the projectile to a particular location or hole such as a spring, to simulate the ball in motion. The outcome of this type of game, such as that disclosed in U.S. Pat. No. 5,183,267 issued to Kohler, is determined by the skill of the player in physically getting a ball to a series of particular holes or locations on a board.

Many of these games do not give a player choices, such as whether to steal a base, to swing in a certain manner, or determine whether a ball will be hit into the air or on the ground. Additionally, many of these games do not allow a player to choose whether to throw a man out, or the manner in which a "play" is to be carried out. Games which have attempted to address this issue have often utilized cumbersome and highly complex game boards to create the varying scenarios of play. For instance, the baseball board game and method of play in U.S. Pat. No. 5,129,651 issued to Tobias, Jr., sets up a highly complex numbering and dice system to determine outcome.

In view of these restrictions and complexities, it would be desirable to have a simple baseball board game which recreated the strategic decisions, player movements and human aspects of the actual game of baseball, but in a portable board game for personal use.

For the purposes of this disclosure, the following terms shall have the respective meanings. The term "playing field board" shall mean a board used by all players for positioning ball and player markers and having a baseball diamond and a modified polar coordinate system drawn on its surface. The term "player board" shall mean a board used by either the offensive or defensive player of the baseball board game to direct action on the "playing field board."

SUMMARY OF THE INVENTION

Generally described, the present invention provides a three paneled board game with two panels being "player boards," representing player decisions, and the third panel representing the playing field. The player boards are comprised of three zones with one zone representing the trajectory of a hit ball, the second zone, a 6×6 matrix, representing the placement of a ball on the playing field, and the third zone representing the type of pitch, or whether a base is stolen during the course of a pitch.

The playing field game board is comprised of a playing field with an alphanumeric polar coordinate system throughout the inner and outer field, to track movement of the ball and player positions during the course of the game. Zones for monitoring the players not in play, as well as the score and strike tally, are also pictured on the board. A plurality of game pieces are used on the boards to represent the ball and bat, and the players from each team.

A ball shaped marker is used to designate the position of the ball on the field and player markers designate the position of players on the field. Placement of a bat shaped marker upon the BALL/STRIKE zone determines whether a hit has been made or base is stolen. Placement of a ball shaped marker upon the 6×6 matrix determines where on the playing field a ball is hit. Placement of a ball shaped marker on a hit zone determines if a ball is an air or ground ball. In a preferred embodiment, the present invention provides for three game boards which contain ferromagnetic substances and magnetic play markers to allow for the retention of the player markers on the board surfaces during play.

In an alternative embodiment, dice are use instead of the player boards to determine ball and player movement.

It is therefore an object of the invention to offer a game which simulates the strategic choices which are present in the actual game of baseball.

Additionally, it is another object of the invention to offer a baseball game which can be played using a portable game board.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENT

The concept of the invention of the "BASEBALL CHESS GAME" is a board game for two or more players. The playing field and the rules of the present invention would be similar to the conventional baseball game. The game is an accurate simulation, simplification, and abstraction of the real baseball game, representing the spirit of the real baseball game. All important events of the game are correlated to each other, and are based on reasonable probability calculation.

Figure 1:
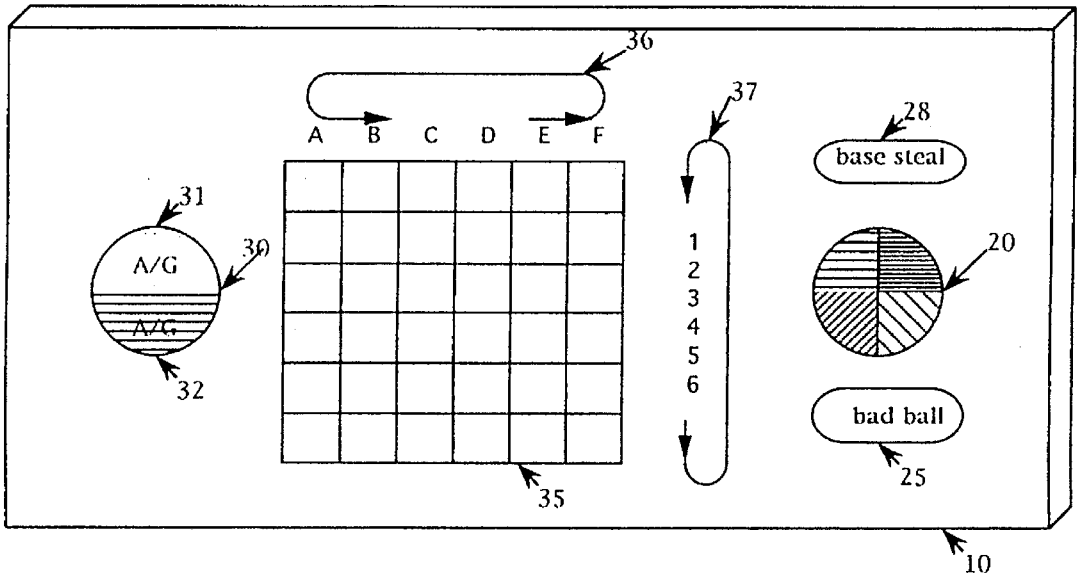
FIG. 1 is a plan view of a player board of the baseball game of the present invention.
Figure 2:
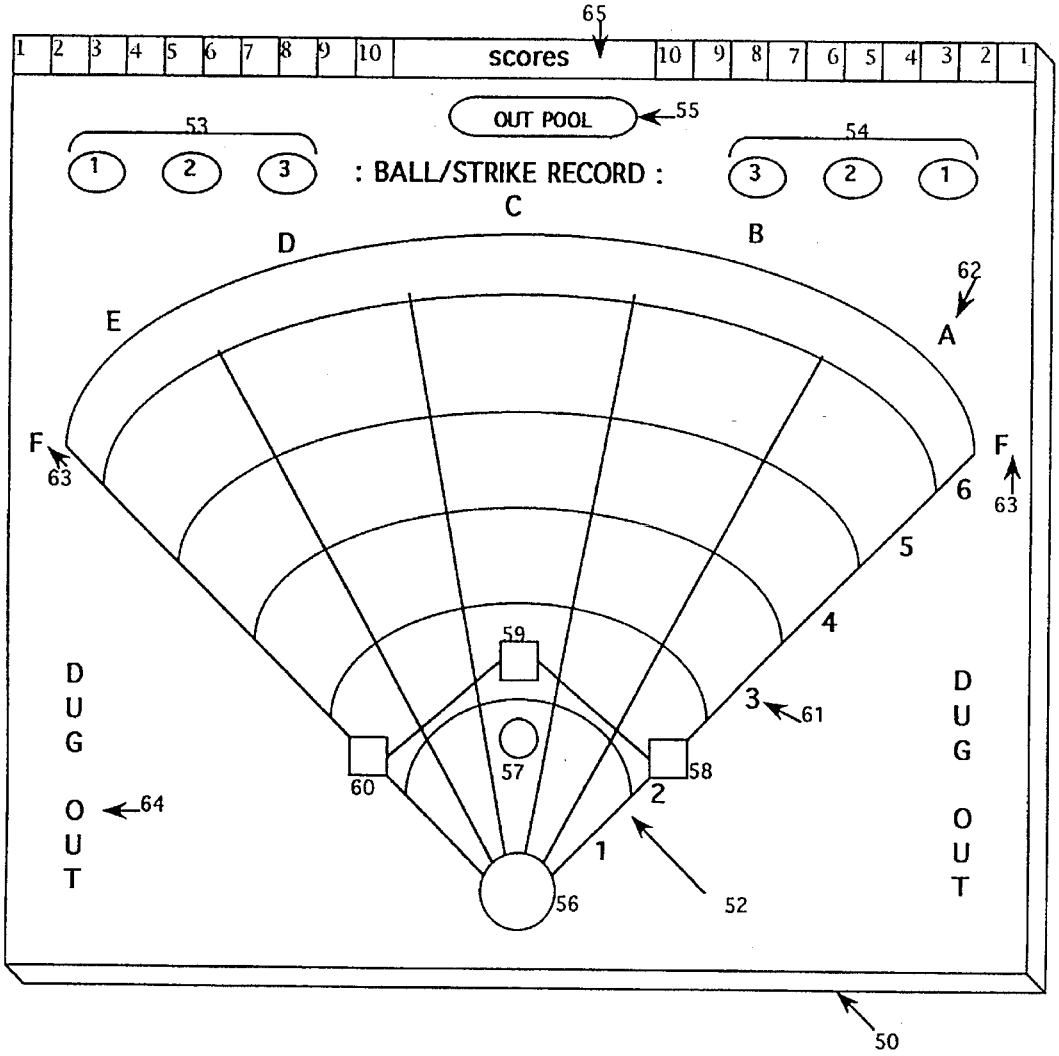
FIG. 2 is a plan view of the playing field board of the present invention.
Figure 3:
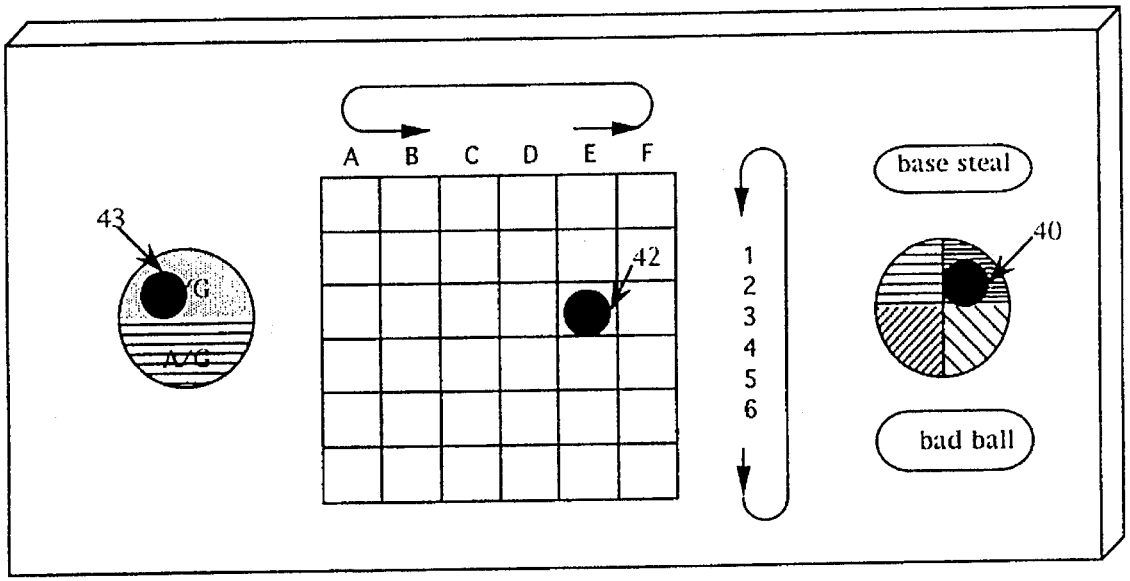
FIG. 3 is a plan view of a player board acting as a defensive player board of the baseball game of the present invention, with play markers attached.
Figure 4:
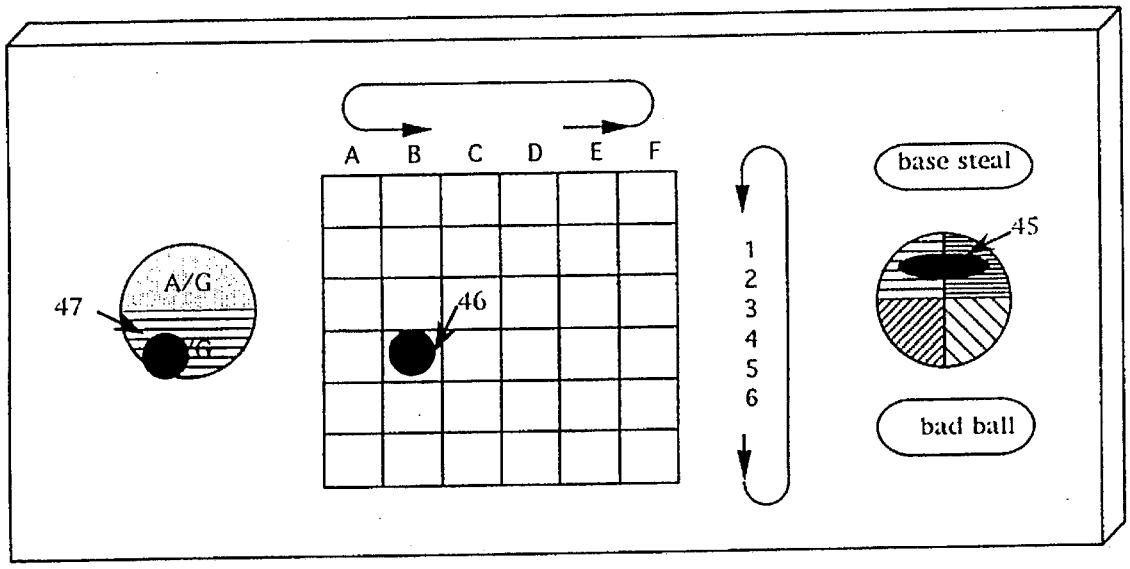
FIG. 4 is a plan view of a player board acting as a offensive player board of the baseball game of the present invention, with play pieces attached.

Referring to the drawings and particularly to the game boards in FIGS. 1 and 2; The present invention utilizes three game boards. Two of the boards are identical, and are called "player boards" 10. The player boards are used to determine whether there is a hit 20, and if there is a hit, whether it is a foul ball 35, an air, or a ground ball 30, and landing position of a hit ball 35. The player boards 10 are made preferably from wood, plastic, cardboard, or other composite material preferably with a ferromagnetic material laminated underneath (not shown), to enable play markers, which also preferably contain ferromagnetic material, to adhere to its surface. The player board 10 is preferably rigid, and either thick enough to be able to stand vertically or foldable so that it may stand on its edge. On the face of the board 10, there is a hit zone 20 which is divided into four quadrants. Each quadrant represents four different types of fair balls. Under the hit zone 20, there is a zone marked "bad ball" 25 for bad balls chosen by the defensive player, or for no swing chosen by the offensive player. Above the hit zone 20, there is a zone marked "steal base" 28 for the offensive player to choose to steal a base and for the defensive player to prevent a stolen base. Trajectory zone 30 on the player board is divided into two semi-circles 31 and 32, which are used to determine the trajectory of a hit ball (air ball or ground ball). The half circle where the defensive player puts a ball (as a marker) is for the air ball 31, and therefore the other half is for the ground ball 32. These halves may be interchangeable. A ball location zone in the form of a 6×6 matrix 35 on the player board is used to determine the location of a hit ball through the coordinate values of the landing ball in the field. The six columns on the matrix 35 are labeled "A" through "F" coordinate values 36, and the six rows are labeled "1" through "6" coordinate values 37. However, "A" does not have to be the first column on the left, nor does "1" have to be the first row, since they are dynamic. The position of the defensive player's ball marker in the matrix determines where the "A" column and the "1" row are. The columns 36 then start at "A" from that point and proceed from the left to the right to the right side, and continue around to proceed from the first column 36 on the left. Similarly, the rows 37 start at row "1" and proceed to the bottom, and continue around to proceed from the first row. In this way, the position of the landing ball can be calculated, as in FIGS. 3, 4, and 5.

In the preferred embodiment, ball and bat markers 40 and 45, respectively, can be magnetic and are preferably encased in plastic or wood. The ball markers 40 ideally resembles a baseball. The bat marker 45 ideally resembles a bat. Since they are preferably magnetic, the ball and bat markers 40 and 45 can adhere on the surface of the player board 50, which preferably has ferromagnetic material laminated underneath. Alternatively the markers may be adhered using VELCRO®underneath, removable adhesive, or by static electric attraction. The markers can be produced in any color, though the same color is recommended. There is one bat 45 and three ball markers 40 for each player board 10 during the game. One ball marker 42 is used as an indicator for the position of the ball in the modified polar coordinate system, and is to be placed on to the 6×6 table 35. One ball marker 43 is used to indicate the trajectory of the ball (air ball or ground ball) in the trajectory zone 30 when there is a hit, and is to be placed in either half 31 or 32 of the trajectory zone 30 on the player board. The remaining ball marker 40 for the defensive player and the bat marker 45 for the offensive player are used to determine whether there is a hit 20. They are to be placed in their respective hit zones. If the positions of the markers 40 and 45 on the offensive and defensive player boards 10 match, there is a hit. If they do not match there is a strike. Alternatively, the markers might be placed in the steal base zone 28, or in the bad ball zone 25.

The present invention has a playing field board 50 representing the playing field. The material of the playing field board 50 is preferably of wood, cardboard or plastic, and preferably has a thin ferromagnetic layer underneath. Pegs 51 represent the players, and also are preferably magnetic and made of wood, cardboard or plastic. This feature enables the game to be played in a moving environment such as in a car, train, or airplane. Preferably there are two sets of player markers 64 of the same size, but in two different colors representing two teams. Additionally there is an extra marker 65 with a color other than the above two (white is suggested), used to represent a ball in the field. This would not be used in an abridged version of the game where no representation of motion is required. This ball would look different from the balls used on the player boards 40, 42, 43, 46, and 47.

The playing field 52 on the main playing field board 50 is in the shape of a 90 degree cone. The color of the board can vary. However, green can represent the natural color of grass. The top neighboring corners contain batting status zones 53 and 54, which are designed to keep tally of balls and strikes for the pitcher and each batter. These zones are preferably labeled "BALL/STRIKE RECORD" with "1", "2", "3" in ovals on each side. One side would be used by the defensive player to record balls, and the other side would be used by the offensive player to record "strikes." Pegs 68 and 69 are also used in this zone for player's markers. A zone labeled "OUT POOL" 55 located between the ball/strike zones 53 and 54 and would be used to monitor the batters or runners who are out in each inning. The batter mount 56 or plate as it is also called and the pitcher mount 57 are represented by circles. The first 58, second 59, and third 60 bases can be either represented by squares or rectangles.

The field is marked with labels to show the distance and the region in which a ball may land. Numbers "1"through "6" 61 are marked down the length of the field and represent the distance or radial coordinate the ball travels in the radial direction. Letters "A" through "F" 62 across the back of the field represent the region or angular coordinate into which ball might land. The foul ball area 63 is represented by an "F", and there are two foul areas 63 on each side out of the fan area 52. Additionally, two areas 64 marked "DUG OUT", are used to hold the player pegs of each team which are not in use.

The basic playing rules are as follows. To set up the main board 50, the player markers 54 are placed in the field positions. The basemen could be anywhere near their bases. The short stop could be any where, for example, between region 3 and region 4. Out fielders can be placed in the outfield regions 4 or 5. The pitcher is placed on the pitcher mount 57. A catcher is placed near the batter mount 56. The defense player places nine markers as a pitcher, a catcher, three basemen, a short stop, and three out fielders in the field 52. The offensive player places a batter on the batter mount 56 and all other players in the "DUG OUT" zone 64. It should be noted however, that the positions of all defense players can be adjusted before each pitch.

The game begins with the two players each taking a player board 10. Each player conceals the boards 10 from each other. The pitch is indicated by placement of a ball marker 40 in the proper spot. For a "fair" ball, the defense player (pitcher) places the ball 40 in only one of the four quadrants of the hitting zone 20, and for a bad ball the defensive player places the ball 40 in the zone marked bad ball 25. However, a bad ball choice may only be utilized after a fair ball has been pitched and therefore, the first pitch must be a fair ball. The defense player may also put the ball indicator 40 in the steal base zone 28 to prevent the stealing of a base. This can only be done for three consecutive "at bats." Additionally, the defensive player needs to place a ball indicator in either half 31 or 32 of the trajectory zone labeled by "A/G" 30. These markers will be used together with the offensive player's indicator in the corresponding zone, to determine the altitude of the ball, if there is a hit. Additionally, the defensive player also needs to place a ball marker 42 in the 6×6 matrix 35, to determined the landing position of the ball, if there is a hit.

The offensive player (batter) must guess what type of ball can be thrown by the pitcher and places his bat marker 45 either in the bad ball area 25 or in the hit zone 20, which must match precisely the quadrant that the pitcher selected if the offensive player is to hit the ball. By the shape of the bat, the offensive player has two options, so the offensive player can place the bat at an angle on any two quadrants in the hit zone 20. If the offensive player expects a bad ball, and chooses not to swing, the bad ball zone 25 can be selected for the placement of the bat. The offensive player also needs to put a ball indicator 47 in either half of the trajectory zone A/G 33, and a ball marker 46 in the 6×6 matrix 35. The offensive player may choose to also put the bat 45 in the steal base zone 28 if the player chooses to steal a base (the stealing base feature will be described later).

Both player boards 10 would be exposed simultaneously after the players had made their moves. The players would then check the hit zone 20 to see if the bat marker 45 matches the pitcher's ball marker 40. If the bat marker 45 matches the pitcher's ball marker 40 in the hit zone 20, the batter is considered to have hit a ball. If not, it is considered a strike and the same process is repeated to determine the next pitch.

Figure 5:
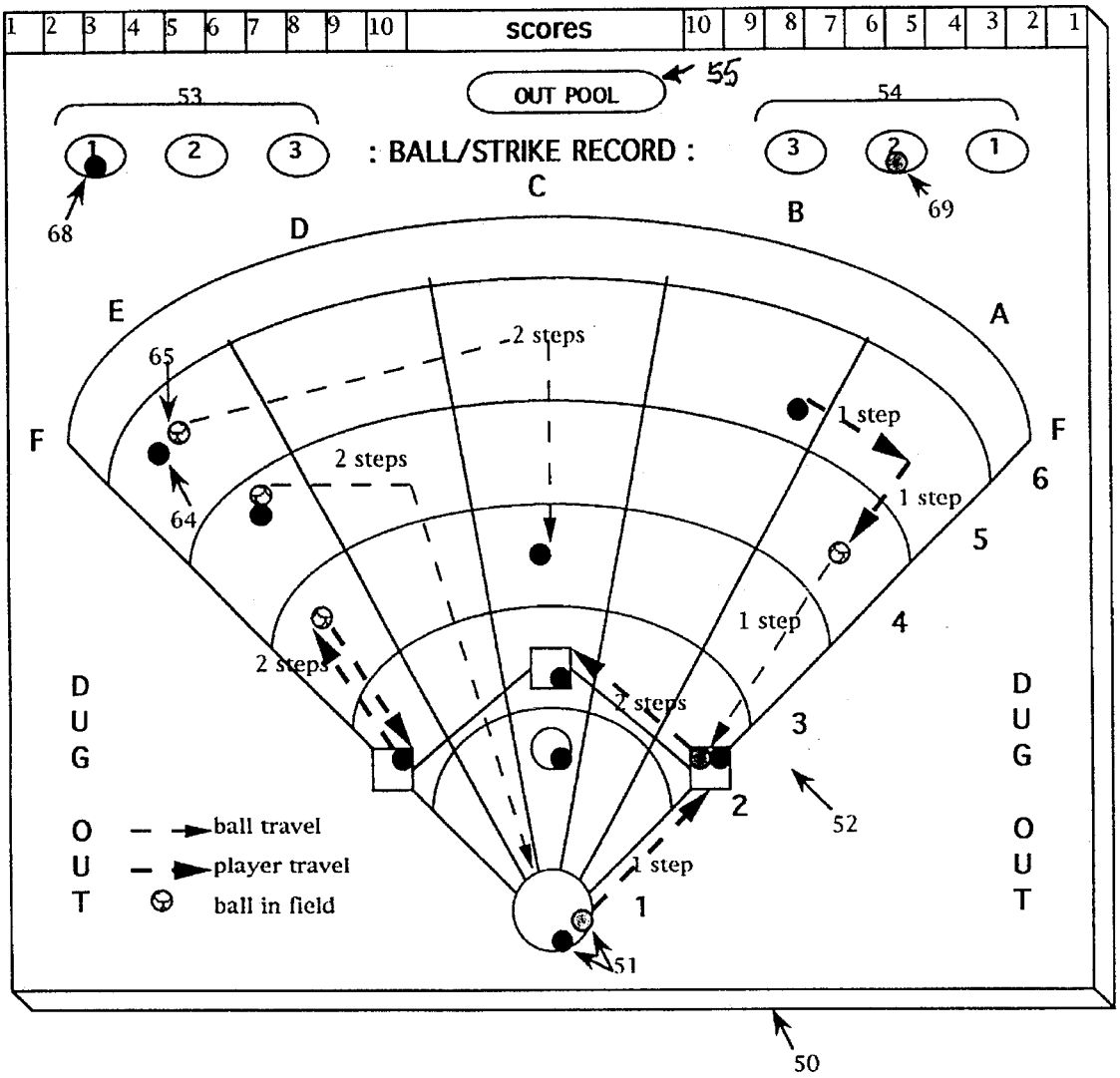
FIG. 5 is a plan view of a the playing field board of the present invention, with markers attached and explanation of marker movements.

If the batter gets a hit, the trajectory zone 30 will be reviewed. If the batter's ball marker 47 in the circle is in the same half circle as the pitcher's ball marker 43, it is considered an air ball. Otherwise it is considered a ground ball. The 6×6 matrix 35 would next need to be reviewed. The pitcher's ball marker in the matrix 35 indicates the starting column, i.e. column A, and the starting row, i.e. row 1. From column A, one moves from left to right. The next column would be B, C, through F. If, during counting, the edge of the matrix is reached, one continues to proceed from the first column at the left by looping back. The same method is used for counting the row 37 except it proceeds from the top to the bottom. The position of the batter's ball marker 46 in the matrix 35 can then be calculated with the starting point determined by the pitcher's ball marker 42, and that determines the landing position of the ball hit. Then the field ball marker 65 is placed into the landing position on the playing field board 52 (FIG. 5). This would not be applicable in the abridged rules. As in the actual game of baseball, if a foul ball is hit, it is considered as a strike. Also, as in the real game, foul balls will not be counted after two strikes for the batter. Four balls of a pitcher will send the batter to the first base, and if the base has a player on it, the runner will proceed to the next base. The batter is considered out after three strikes.

The basic playing rules of the present invention have a "base stealing" feature. The only prerequisite for the base stealing option is that there must be a runner on first or second base and the next base is empty. A batter can choose to steal a base by placing the bat in the steal base zone 28. If the pitcher does not prevent this by putting the ball marker also in the base steal zone 28, but throws a fair ball, the base will be stolen. If both the ball and bat are in the steal base zone 28 at the same time (when exposing the player board), and if there is a defensive player on the empty base to be stolen, the base stealer is considered out. The stealing is limited to only one time per batter. There is no limit for the defensive player putting the ball on to the steal base region 28, except that it may used no more than three consecutive moves. Additionally, in the case of a base stealing, if a fair ball is pitched, it is regarded as a "strike" to the batter, if a bad ball is pitched, it is regarded as a "ball" to the pitcher, and the base stealing would not count.

The following paragraphs describe the standard rules of motion for the pegs (representing ball and players) in the playing field 52. After the players determine that a hit has been made, the extra marker 65 representing the ball in playing field 52, is placed in position. If an air ball lands where there is a fielder, the batter is considered out. But an air ball does not prevent the runner on scoring position (second and third base) from running. However, the runner will have one step delay as a penalty for an air ball. In this way, "sacrificing" is available as in the real baseball game. An air ball with a landing coordinate 6A through 6E (except 6F, which is still a foul ball) results in a home run. A ground ball with a landing coordinate 6A through 6E indicates that the ball will bounce back to region 5 of corresponding coordinates, and will be treated as a ground ball landing at the region with no penalty for the runner. In each step, both players can move their markers with no limit in numbers, and the ball for allowed distances. The offensive player starts the first step and the defense player moves markers in the next step. In one step, the players (markers for batter, runners, and fielders) can travel one block. For example, a player may travel from 2B to 2C and from 3A to 2A. A ball can not start traveling by itself, but has to be caught and thrown by a player in the field 52. The ball can travel up to two blocks in a step. No ball nor players can travel diagonally. For example, no player can travel from coordinate 5B to 4A directly. The player would have to travel through either 5A or 4B. Additionally, a ball thrown by one defensive player can not travel more than four blocks directly. If the ball reaches a base (including the home) before or at the same time as a runner does, and if there is a baseman on the base or reached the base earlier, the runner is considered out. The pitcher mount is not an individual block, but belongs to region 1 (1A through 1E). Therefore it takes only one step for the runner to move from the pitcher mount to the first base, and from the third base to home. Since no player is allowed to restart the motion, both players need to plan the motion well. For example, if the defensive player needs a relay in a position later, the player should move a player marker to the position earlier. The process will be ended if no motion is necessary for the offensive player. In FIG. 5, examples are given to show the movements of markers (representing balls and the players in the playing field 52) under the standard rules of motion. It illustrates the third baseman taking two steps to get a ball and travel back to third base. A batter takes one step to get to first base, and a runner at first base takes two steps to reach second base. The steps needed for other movements of balls and players are also illustrated.

After each matching of the pitcher and batter, both players need to put a marker 68 and 69 as a marker in the zones 53 and 54 of BALL/STRIKE RECORDS to indicate the batting status. For offensive players, it indicates the number of strikes for the batter. For defensive players, it indicates the number of balls of the pitcher for the batter. When a player is considered "out" for any reason, the marker should be removed from the base or the batter mount and be put in the OUT POOL, zone 55, until three players are out. At that time the half inning is over and the players exchange offense and defense positions for the game to continue.

Scores can be recorded either on paper or on region 56 of the playing field board. The playing rules are flexible and can be altered slightly by players before the game. For example, the players may agree to play for only five innings instead of nine. Also they may only choose to use only three quadrants in hit zone 20 of the player board 10, to have a higher scoring probability.

The standard rules of motion of the present invention have a feature of an automatic "double play". If the ball was hit by the batter who has two strikes and there is a runner on the first base, as long as the defense team has enough time (steps), it is possible for both the batter and the runner on the first base to be thrown out.

The standard rules of motion of the present invention would automatically have a feature of "sacrifice." When there are less than two outs for the offensive team while a runner is in scoring position (second base or third base), and if an air ball lands where there is a defensive player, the runner can choose to run and even to score, but with one step delay as penalty. The batter is considered out or sacrificed.

Additionally, the present invention has abridged rules, other than the standard rules of motion, designed primarily for beginners, and which are not used at the same time as the standard rules of motion. According to the abridged rules, base running is only determined by the positions of the defense players and the landing position of the hit ball. A ball landing in region F (IF through 6F) is a foul ball. If a foul ball is hit, it means a strike. It does not count after two strikes, and the players should go back to use player boards again. If a hit ball lands in a position where there is a defensive player, the batter is considered to be out no matter if it is a ground ball or an air ball, except in region 5 (5A through 5E) where it is consider a "single" even if there is a fielder in the landing position. If an air ball lands in region 6 (6A through 6E), it is considered a "home run."If it is a ground ball in region 6, it will be considered as being bounced back to region 5 of the same angular position. If the ball lands in region 1 and 2 (1 A through 1E and 2A through 2E) with no defense player is in the landing position, it is considered as a "single." If the ball lands in region 3 and 4 (3A through 3E and 4A through 4E) with no defense player in the landing position, it is considered as a "double." If the ball lands in region 5 (5A through 5E) with no defense player is in the landing position, it is considered as a "triple." For a "single," a "double," and a "triple", the batter moves to the first, the second, and the third base respectively, and all the runners on base (if any) move forward the same amount accordingly.

The abridged rules have a double play feature which is different from the standard rules of motion, where the double play is an automatic result of the motion under the rule. If there are two "strikes' for the batter and a runner is an first base, and a ball lands in region 1 (1A through 1E) and 2 (2A through 2E) in a position having a defense player, both the batter and the runner on first base are considered out.

The abridged rules have a sacrifice feature as well. If there is a runner on the third base with less than two outs, and if a ball was hit as an "air" ball landing in region 4 or 5 (i.e. 4A through 4E and 5A through 5E), the batter would be considered out, but the runner on third base can run and score.

Figure 6:
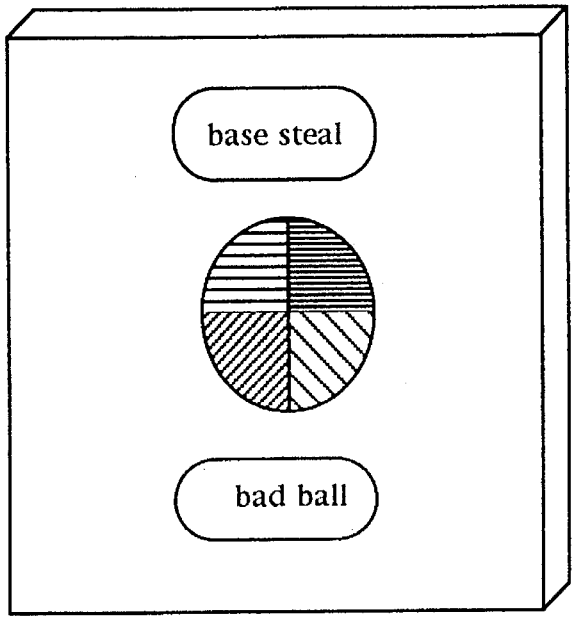
FIG. 6 is a plan view of an alternative player board.
Figure 7A:
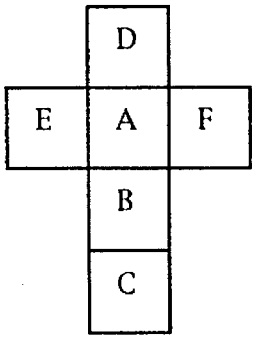
FIG. 7 is a plan view of an alternative embodiment of a player board components in the form of dice.
Figure 7B:
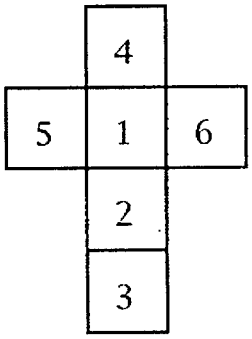
Figure 7C:
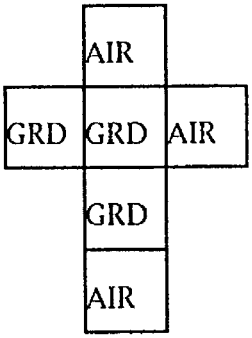

In an alternate embodiment, the present invention could have a variation of the player board (FIG. 6). Instead of using the whole player board, only the part which contains the hit zone 20, the "stolen base" zone 28, and the "bad ball" zone 25 can be used for a simplified player board. Using this simplified player board together with three dice, one can obtain almost all the functions of the previous player board. In this alternative embodiment, one die with six letters "A" through "F" on its six faces is used to determine the angular coordinates (FIG. 7(*a*)). One die with number "1"through "6" on its six faces (FIG. 7(*b*)) is used to determine the radial coordinates. Together they can determine all the positions on the playing field board. Another die with "GRD" on its three faces and "AIR" on the other three faces (FIG. 7(*c*)) is used to determine whether it is an air ball or a ground ball if there is a hit. Similarly to the original version of the game, the players start the game by using the simplified player boards to determine if there is a hit. After a hit, the offensive player throws the three dice to find out the landing position and the altitude of the ball hit. Then either the basic rules of motion or the abridged rules can be used with this alternate embodiment.

While the invention has been described in connection with certain preferred embodiments, it is not intended to limit the scope of the invention to, the particular forms set forth, but, on the contrary, it is intended to cover such alternatives, nodifications, and equivalents as may be included within the spirit and scope of the invention as defined by the appended claims.

I claim:

1. A baseball board game to be played by two or more players comprising:

a playing field board having an area defined thereon representing a baseball diamond, said baseball diamond having a left and right side and an arc delineating an infield and an outfield, said diamond comprising a modified polar coordinate system with radial coordinates along the sides of said diamond and angular coordinates along said arc of said diamond;

two player boards, said player boards having five zones defined thereon, said zones representing a trajectory zone; a hit zone; a ball location zone; a bad ball zone; and a stolen base zone;

a plurality of player markers for marking the positions of players upon said playing field board;

a plurality of ball markers for representing the moves of a baseball upon said playing field board and said player boards;

a bat marker for representing the swing of a bat on said player boards; and, whereby as a player chooses his/her moves on said player boards, such moves can be reflected upon said playing field board.

2. The baseball board game according to claim 1, wherein said playing field and said player boards are made of a material selected from the group consisting of wood, plastic, cardboard, and composite material.

3. The baseball board game according to claim 1, wherein said playing field board, said player boards, said player markers, said ball markers and said bat marker contain ferromagnetic material.

4. The baseball board game according to claim 1, wherein said playing field board, said player boards, said player markers, said ball markers and said bat marker utilize adherence material selected from the group consisting of VELCRO, hook and loop fasteners, and adhesives.

5. The baseball board game according to claim 1, wherein said player boards stand freely on their edge.

6. The baseball board game according to claim 1, wherein said player boards can fold into three segments so that said player boards may stand freely on their edge.

7. The baseball board game according to claim 1, wherein said playing field board includes a zone for keeping score, a zone for maintaining count of balls and strikes, two dugout zones, and an outpool zone.

8. A baseball board game according to claim 1, wherein said radial coordinates total 6 in number.

9. A baseball board game according to claim 1, wherein said angular coordinates total six in number.

10. A baseball board game according to claim 1, wherein each of said player markers are colored to distinguish between teams.

11. A baseball board game to be played by two or more players comprising:

a playing field game board having a baseball diamond drawn over said game board, said baseball diamond having a left and right side and an arc delineating an infield and an outfield, said diamond comprising a modified polar coordinate system with radial coordinates along the sides of said diamond and angular coordinates along the arc of said diamond; and, one player game board, having a zone defined thereon representing a hit zone, a stolen base zone, and a bad ball zone;

a trajectory die, said die labeled with "air" on three sides and "grd" on three sides;

a radial coordinate die, said die having sides consecutively numbered from 1 to 6; and, an angular coordinate die, said die having sides alphabetically labeled from A through F;

a plurality of player markers for marking the positions of players upon said playing field board;

a plurality of ball markers for representing the moves of a baseball upon said playing field board arid said player board;

a bat marker for representing the swing of a bat on said player board; and whereby as a player chooses his/her move on said player board and hitting dice, such move can be reflected upon said playing field board.

12. A baseball board game to be played by two or more players comprising:

a playing field board containing ferromagnetic material and having an area defined thereon representing a baseball diamond, said baseball diamond having a left and right side and an arc delineating an infield and an outfield, said area being divided into a plurality of sub-areas comprising a modified polar coordinate system with radial coordinates along the sides of said diamond consecutively numbered 1 through 6, and angular coordinates along said arc of said diamond alphabetically labeled A through F; said playing field board further having an area defined thereon representing a scoring zone, Ball/Strike zones, two dug out zones and an out pool zone;

a player game board, having a zone defined thereon representing a hit zone, a stolen base zone, and a bad ball zone;

a trajectory die, said die labeled with "air" on three sides and "grd" on three sides;

a radial coordinate die, said die having sides consecutively numbered from 1 to 6;

an angular coordinate die, said die having sides alphabetically labeled from A through F;

a plurality of player markers containing ferromagnetic material, used for marking the positions of players upon said playing field board each of said markers colored to distinguish between teams;

a plurality of ball markers containing ferromagnetic material, used for representing the moves of a baseball upon said playing field board and said player board; and a bat marker containing ferromagnetic material, used for representing the swing of a bat on said player board, whereby as a player chooses his/her move on said player board and hitting dice, such move can be reflected upon said playing field board.

* * * * *